US010166426B2

(12) United States Patent
Adeeko, Jr.

(10) Patent No.: US 10,166,426 B2
(45) Date of Patent: Jan. 1, 2019

(54) EXERCISE APPARATUS

(71) Applicant: Olugbenga Peter Adeeko, Jr., San Diego, CA (US)

(72) Inventor: Olugbenga Peter Adeeko, Jr., San Diego, CA (US)

( * ) Notice: Subject to any disclaimer, the term of this patent is extended or adjusted under 35 U.S.C. 154(b) by 0 days.

(21) Appl. No.: 15/237,304

(22) Filed: Aug. 15, 2016

(65) Prior Publication Data

US 2018/0193686 A1 Jul. 12, 2018

Related U.S. Application Data

(60) Provisional application No. 62/205,694, filed on Aug. 15, 2015.

(51) Int. Cl.

| | |
|---|---|
| ***A63B 21/00*** | (2006.01) |
| ***A63B 21/055*** | (2006.01) |
| ***A63B 23/04*** | (2006.01) |
| *A63B 69/00* | (2006.01) |

(52) U.S. Cl.

CPC ..... *A63B 21/0557* (2013.01); *A63B 21/4005* (2015.10); *A63B 21/4009* (2015.10); *A63B 21/4011* (2015.10); *A63B 23/0464* (2013.01); *A63B 69/0059* (2013.01)

(58) Field of Classification Search

None

See application file for complete search history.

(56) References Cited

U.S. PATENT DOCUMENTS

| | | | | |
|---|---|---|---|---|
| 1,544,162 | A * | 6/1925 | La Vigne | A61F 5/02 2/44 |
| 5,167,601 | A | 12/1992 | Frappier | |
| 5,203,754 | A | 4/1993 | Maclean | |
| 6,129,691 | A * | 10/2000 | Ruppert | A61F 5/026 128/845 |
| 6,450,131 | B1 * | 9/2002 | Broman | A61F 5/026 119/857 |
| 7,553,266 | B2 * | 6/2009 | Abdoli-Eramaki | A61F 5/026 482/124 |
| 7,699,761 | B1 | 4/2010 | Dieter et al. | |
| 7,758,436 | B2 | 7/2010 | Reynolds | |
| 2011/0111930 | A1 | 5/2011 | Byrd et al. | |
| 2013/0045842 | A1 | 2/2013 | Wood | |

* cited by examiner

*Primary Examiner* — Stephen R Crow

(74) *Attorney, Agent, or Firm* — Donn K. Harms

(57) ABSTRACT

A running exercise device is provided having a waist engaged belt connected to a first shoulder strap and second shoulder strap. Elastic bands extend between the waist belt and each of first and second leg bands positionable on the upper legs of the user. Lower leg bands may also be employed which have elastic leg bands extending between each lower leg band and a respective shoe on the foot of the user.

8 Claims, 6 Drawing Sheets

EXERCISE APPARATUS

This application claims priority to U.S. Provisional Patent Application Ser. No. 62/205,694 filed on Aug. 15, 2015 and incorporated herein by this reference in its entirety.

BACKGROUND OF THE INVENTION

1. Field of the Invention

The present invention relates generally to exercise and athletics. More particularly it relates to a resilient resistive exercise device for runners which provides an elastic resistive force during running exercise which is self-contained and portable.

2. Prior Art

Competitive sports where athletes compete in various forms of athletic endeavors have been popular since the athletic contests started in ancient Greece. In training for such contests athletes continually seek means for exercise which will allow them, for example, to run faster and jump higher and for longer distances.

Every year records for different athletic contests continue to be broken which causes an elevation of the goals for subsequent athletes. As a consequence, athletes continue to seek exercise and training regimens and equipment to aid in their quest to meet and surpass these increasing performance levels.

For many athletic activities, such as for example sprinting and middle distance running, basketball, football, baseball and soccer, leg strength, core strength, and speed enhancement remains a crucial element to improved performance. For many of such athletic activities which require running and sprinting, athletes need more than just excellent leg strength. In addition they must have quick leg acceleration and high knee lift, while concurrently having the good form to maintain the knees in reasonable alignment.

As a result of the stressing of high knee lift, as a characteristic of good sprinting form, in recent years trainers have stressed in their coaching to athletes to run with "high knees." As a consequence, in training for their sport many athletes artificially exaggerate their knee lift during sprinting and focus on training the hip flexors.

This focus on exaggerated knee lifting and hip flexor training is the wrong approach. The characteristically high knee lift of sprinters, is a byproduct of a powerful downward leg drive. Isaac Newton's first law of motion states, for every action there is an equal and opposite reaction. As a consequence, the energy and force generated by such a powerful downward leg drive, is directed downward into the ground. The ground concurrently exerts and equal and opposite force which is then returned to the athlete, propelling their leg forward and upward.

The resulting upward and forward movement of the leg is additionally aided by the elastic stretch reflex nature of the muscle fibers. During the backswing of the leg in a running motion, the leg can only move a limited rearward distance. This is due to the resistance of the hip flexors to such motion which communicate a spring like elastic reflex to the leg, which then propels the leg forward and upward.

There are a large number of prior art references which teach methods and components configured to aid in the sprinting training of athletes. For example U.S. Pat. No. 7,494,453 (Wehrell) teaches the employment of a device for improving sprint speed which tethers the user to the device. However, Wehrell by tethering the user, restricts their movements and their ability to exercise without the apparatus.

A similar apparatus is disclosed in U.S. Pat. No. 5,465,428 (Earl) which teaches an apparatus which is configured to provide resistance to the hip flexors during use. However, as noted earlier, this is the incorrect muscle group on which to focus exercise for the athlete to develop running speed.

As such, there exists an unmet need, for a system and apparatus which is configured to strengthening the hip extensors (hamstrings and gluteus) during use. Unlike the tethered devices and systems taught in prior art, such a device should be fully portable allowing the user to use it anywhere, while concurrently allowing the user to run and exercise unrestrained during such use.

It should be noted, the forgoing examples of related art and limitations related therewith are intended to be illustrative and not exclusive, and they do not imply any limitations on the exercise device and method described and claimed herein. Various limitations of the related art are already known or will become apparent to those skilled in the art upon a reading and understanding of the specification below and the accompanying drawings.

An object of the present invention is the provision of a sprinting exercise device which is configured to provide a strengthening of the hip extensors during use.

It is another object of the invention to provide such an exercise device, which is configured to be worn by the user during use, thereby allowing such use anywhere.

Further objectives of this exercise invention will be brought out in the following parts of the specification wherein the summary and detailed description of the invention are for the purpose of fully disclosing the invention without placing limitations thereon.

SUMMARY OF THE INVENTION

The present invention provides a solution to the noted shortcomings in the art, through the provision of a user-worn device exercise adapted to provide the user exercise to enhance their subsequent performance during running, sprinting, jumping, and other leg-driven athletic endeavors.

In a preferred configuration of the device, in all modes herein, the device includes a chest harness assembly adapted for chest and shoulder engagement, a belt assembly configured for engagement around the waist of mid section of the user, a pair of leg belt assemblies each of which is adapted for a biased compressive encircled engagement to one leg of the user, and a pair of elastic members configured for engagement between the leg belt assemblies and the belt assembly.

The belt assembly is made of an elastic body such as neoprene or another elastic material. Securement of the belt assembly around the waist or mid section of the user is accomplished using mating fasteners positioned on each end of the body of the belt assembly. Currently, such mating fasteners are provided by hook and loop fabric being engaged to one end of the body of the belt assembly which is adapted to engage mating hook and loop fabric connected to the opposite end of the body of the belt assembly. Such might include a length of hook or loop fabric extending from one end of the body of the belt assembly which is adjustably engageable with mating hook or loop fabric connected to the opposite end of the body of the belt assembly. Of course other means for holding the belt assembly body to the mid section of the user may be used such as belts, or loops, or other connectors to hold the body of the belt assembly in place on the front of the body of the user at their waist or in-between the hips and shoulders.

Forming the body of the belt assembly from an elastic material such as neoprene, or woven material including elastic yarn or thread, allows the body of the belt assembly to slightly elongate when connected by the belt or hook and loop fabric or other cinching member. This slight elongated imparts a compressive bias to the body of the belt assembly when engaged at the mid section of the user, which helps hold it in place during use.

The device as noted also includes a chest harness configured for engagement over the shoulders and encircling a chest area of the user. In a preferred mode, the chest harness features two curved straps, configured to follow a path over each shoulder of the user and curving to position the distal end of each cured strap under the arms of the user where the distal ends may engage each other in the chest area of the user.

Cooperatively engageable fasteners extending from each respective distal end of each curved strap, allow for a removable engagement of both distal ends by engagement of the cooperative connectors thereon to each other.

Connecters engaged with a first end of each shoulder strap, are configured to engage with complimentary connectors positioned on the body of the belt assembly. With the connectors so engaged, the shoulder straps are engaged to the body of the belt assembly, providing a pair of tethers which prevent the body of the belt assembly from moving downward or toward the feet of the user during use.

As noted, each leg of the user, is encircled by one of the pair of leg belt assemblies. The leg belt assemblies are preferably formed of an elastic fabric such as neoprene, or a woven textile type fabric having elastic thread or yard therein. Opposite ends of each leg belt assembly have mating fasteners thereon which will connect, and engage the leg belt assembly in a mounted position encircling one leg of the user. If formed of an elastic material, the leg belt assembly can be stretched and the mating fasteners engaged to hold the leg belt assembly in an elongated position where the elastic will impart a bias to the leg belt assembly and hold it in a compressive encircled engagement with a leg.

Engageable between the body of the belt assembly and each respective leg belt assembly, are as noted and a pair of elastic members. At each end of each elastic member is positioned a connector which is adapted to removably engage with one of a mating connector mounted on the leg belt assembly or a mating connector mounted on the body of the belt assembly.

The distance between the mating connector on the body of the belt assembly and the mating connector on the leg belt assembly, is longer than the distance from one end of the each elastic member to the opposite end. As such, when each of the elastic members is connected in-between a pair of the mating connectors on the body of the belt assembly and the mating connector on a leg belt assembly, it must be stretched slightly and will exert a slight bias when connected.

With the shoulder harness, belt assembly, leg belt assemblies and elastic members operatively engaged, thereby positioning the device in an as-used positioning, the elastic members of the device impart a resistance to the movement of the hip extensor muscle groups which consist primarily of the gluteus and hamstrings, when the user walks or runs.

The elastic cords impart such resistance because of the way they are attached in-between the waist belt assembly and leg belts assemblies. During movement of the leg forward, the elastic cord or members must be stretched by the muscles of the user. The chest harness is preferably included as in experimentation it was found to help maintain the body of the belt assembly in place by providing a means to counteract the downward pull of the elastic cords upon the body of the belt assembly.

By employing removably engageable elastic bands or members, the device can provide such in a kit having more or less resistance to elongation, but formed in substantially the same length with connectors on each end. In this fashion, the user may adjust the resistance and amount of exertion and exercise provided, by engaging elastic members having more or less resistance to elongation. The elastic members can be color coded so that the user can discern matching pairs by color, and resistance levels of each pair chosen.

In an enhanced mode of the device herein, there is also included a pair of lower leg belts engaged adjacent the knee, and two elastic resistive leg bands which connect between each lower leg belt and a respective shoe of the user. It has been found that including the two lower leg bands with elastic bands connected to the shoes of the user, strengthens the posterior chain and helps prevent subsequent hamstring injuries by strengthening that muscle group. Additionally, the inclusion of the lower leg bands with elastic biased shoe connections provides increased step length to the user while concurrently aiding them by improving their subsequent posture and gait. Further, use of the device with the lower leg bands and shoe connections included encourages initial contact during walking and especially running to be on the front and consequently it aids in acquiring muscle memory to eliminate injuries to runners who are heel strikers. Consequently, the mode of the device inclusive of the lower leg bands and elastic bands extending to each foot is especially preferred for training and exercising both athletes as well as non athletes.

With respect to the above description, before explaining at least one preferred embodiment of the herein disclosed exercise system and device in detail, it is to be understood that the invention is not limited in its application to the details of construction and to the arrangement in the following description or illustrated in the drawings. The exercise invention herein described, is capable of other embodiments and of being practiced and carried out in various ways which will become obvious to those skilled in the art on reading this disclosure. Also, it is to be understood that the phraseology and terminology employed herein are for the purpose of description and should not be regarded as limiting.

As such, those skilled in the art will appreciate that the conception upon which this disclosure is based, may readily be utilized as a basis for designing of other user-worn exercise systems and devices and for carrying out the several purposes of the present disclosed system. It is important, therefore, that the claims herein be regarded, as including such equivalent construction and methodology, insofar as they do not depart from the spirit and scope of the present invention.

BRIEF DESCRIPTION OF DRAWING FIGURES

Figure 2:
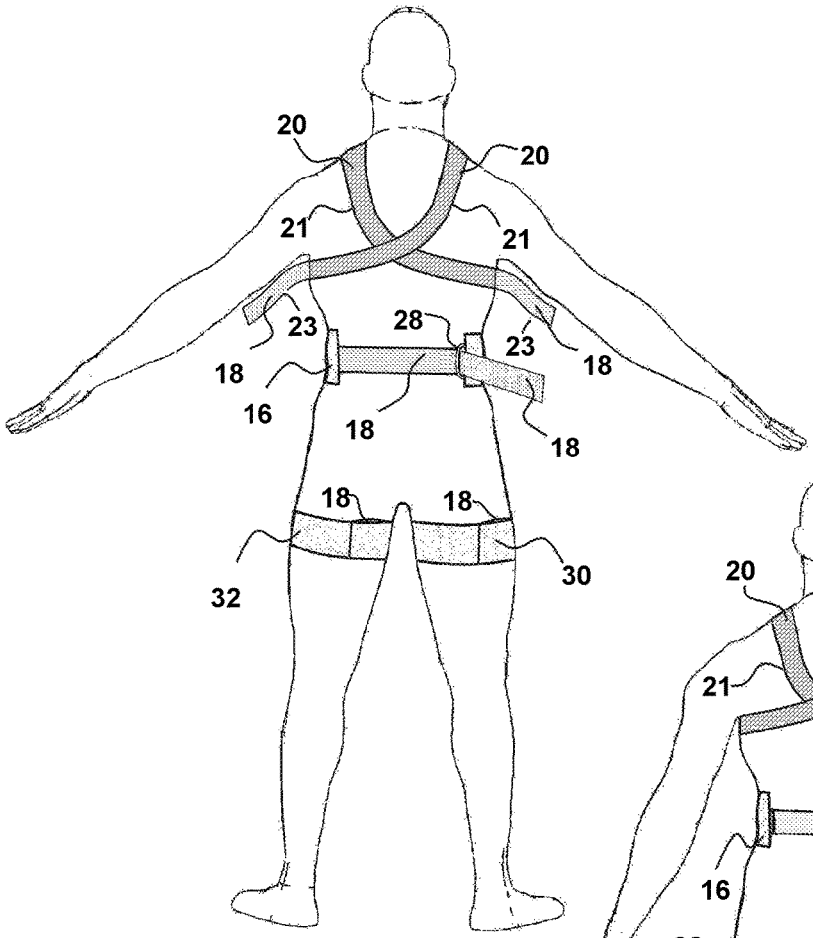
FIG. 2 depicts a rear view of the device herein during engagement with a user to an as-used positioning, showing curved shoulder straps having mating hook and loop fabric and the belt assembly having an adjustable belt extension.
Figure 3:
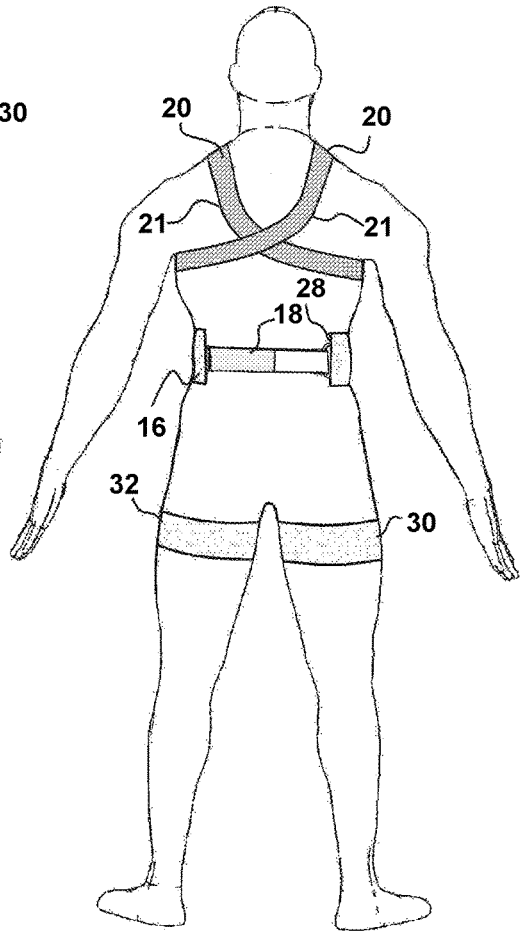
Figures 4, 4A:
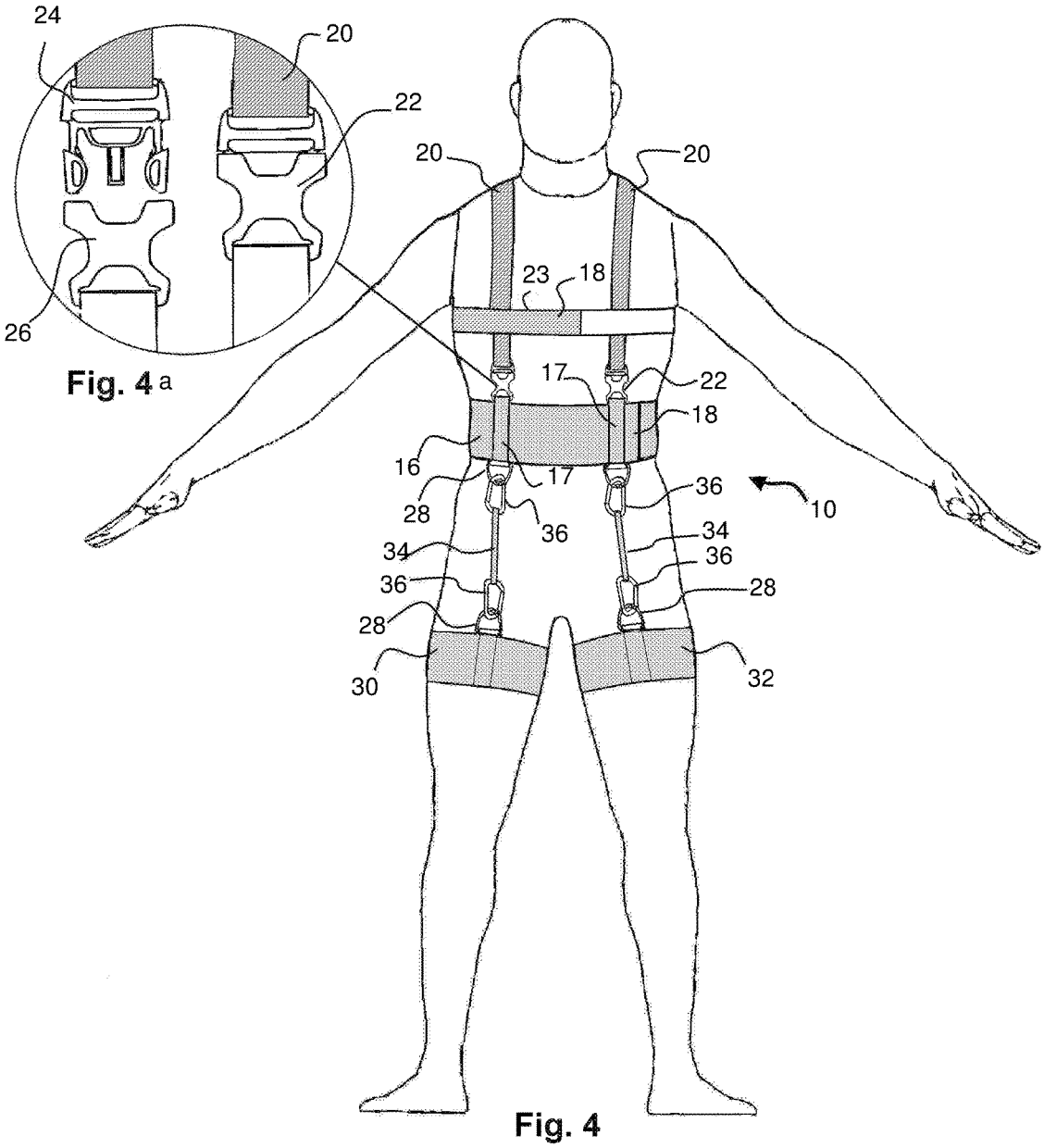

FIG. 3. shows the device as in FIG. 2, wherein the shoulder straps have been engaged with each other across the chest of the user as in FIG. 4, and the adjustable belt has been removably connected to hold the belt in position.

FIG. 4 shows the device in an as-used positioning with the shoulder straps connected to the belt which is encircling the waist or mid section of the user, and showing the two elastic members extending between respective connections with a leg belt and the belt operatively engaged with the waist of the user.

FIG. 4*a* depicts complimentary mating connectors which may be employed between the shoulder straps and the waist-engaged belt, and could be employed to connect other components such as the elastic members which are shown removably connected with b-rings and carabineers.

Figure 5:
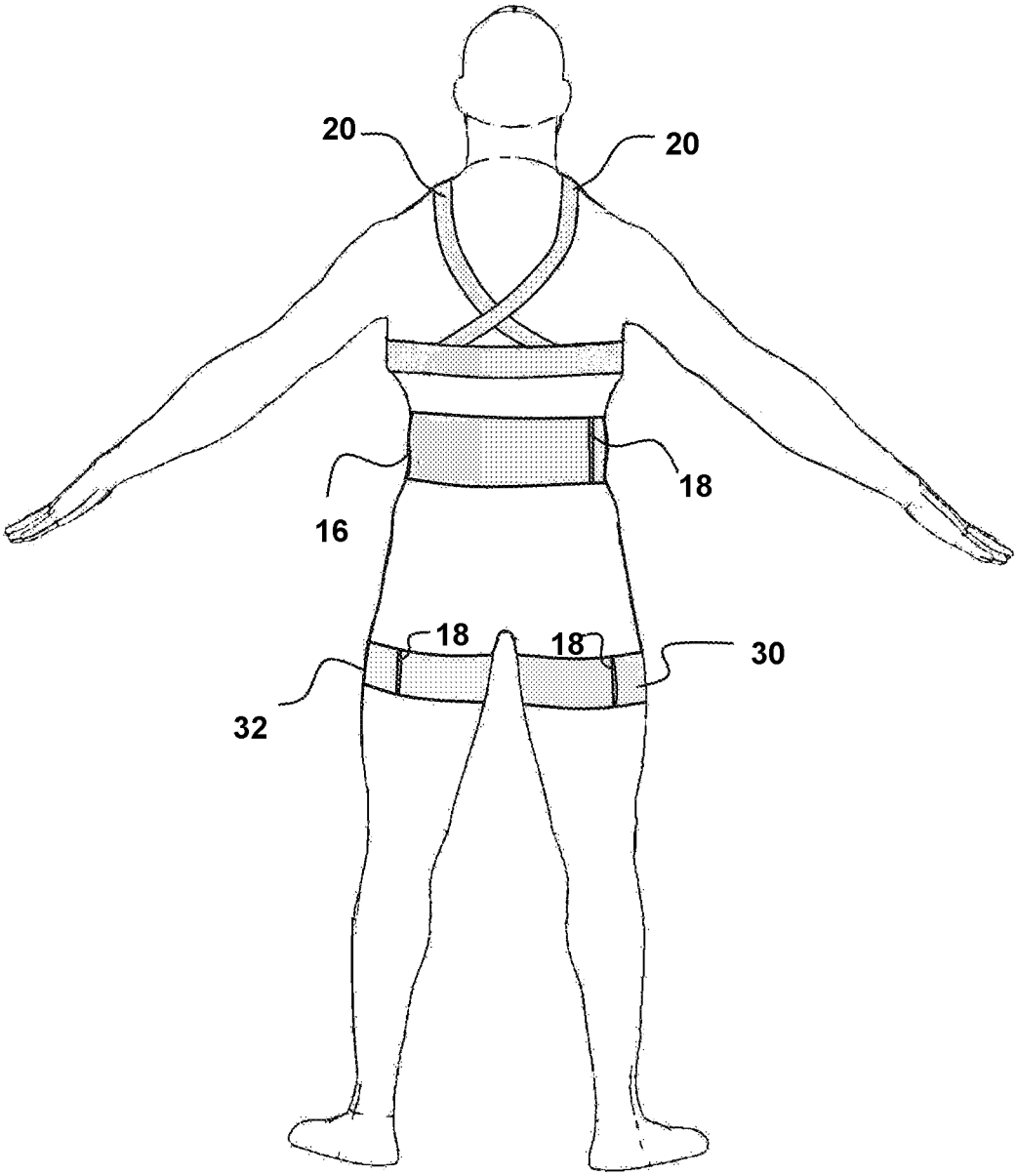

FIG. 5 shows another mode of the device where the shoulder harness includes the shoulder straps engaged at one end to an encircling belt which can be removably connected across the chest of the user and showing the two leg belts engaged to the upper legs or thighs of the user with the device in an as-used positioning.

Figure 6:
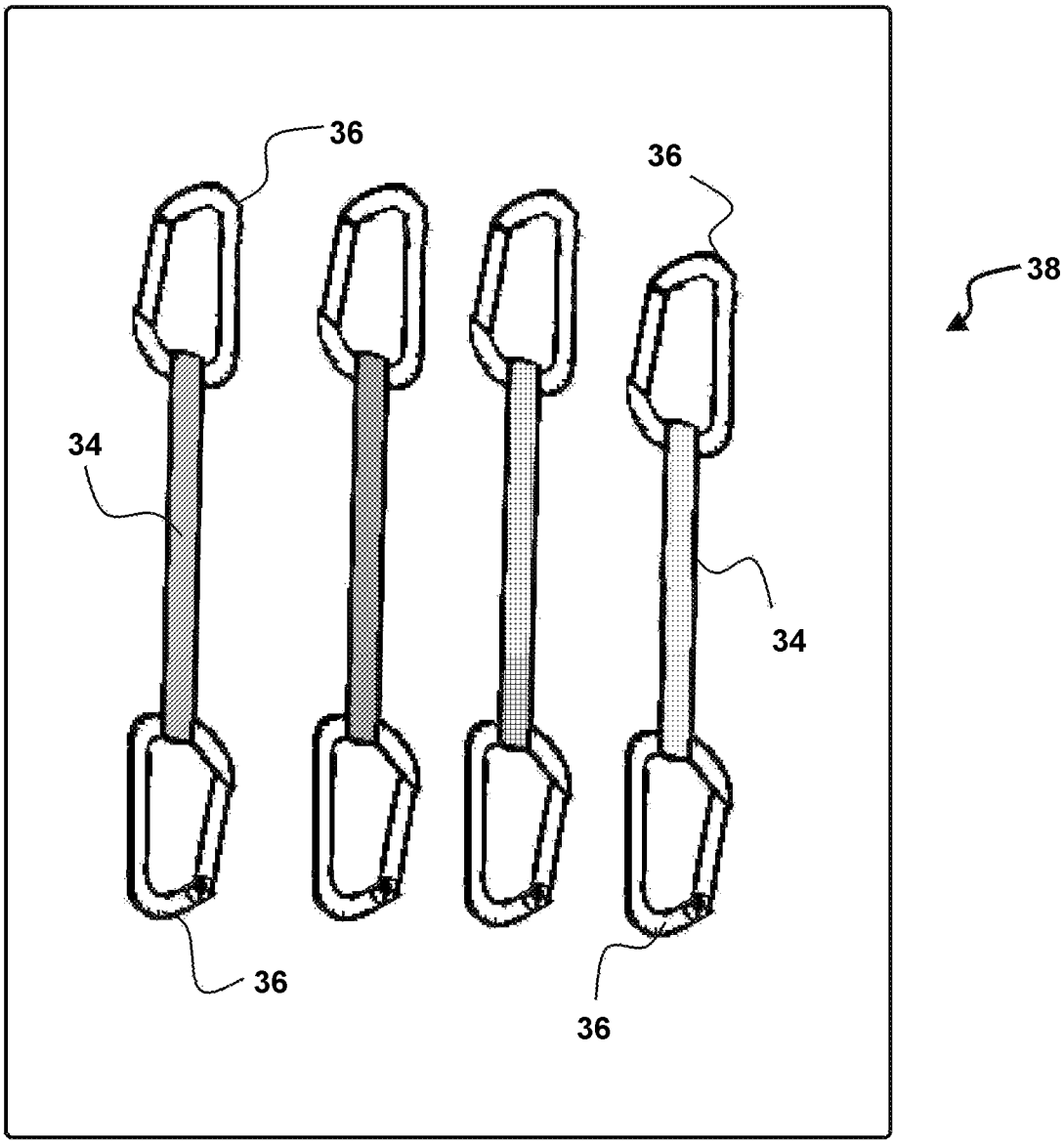

FIG. 6 depicts elastic members in a kit of such elastic members where each has a different force of resistance to elongation, and showing the carabineers which provide the mating removable connection with D-rings engaged to the body of the belt assembly and to the leg belt assemblies.

Figure 7:
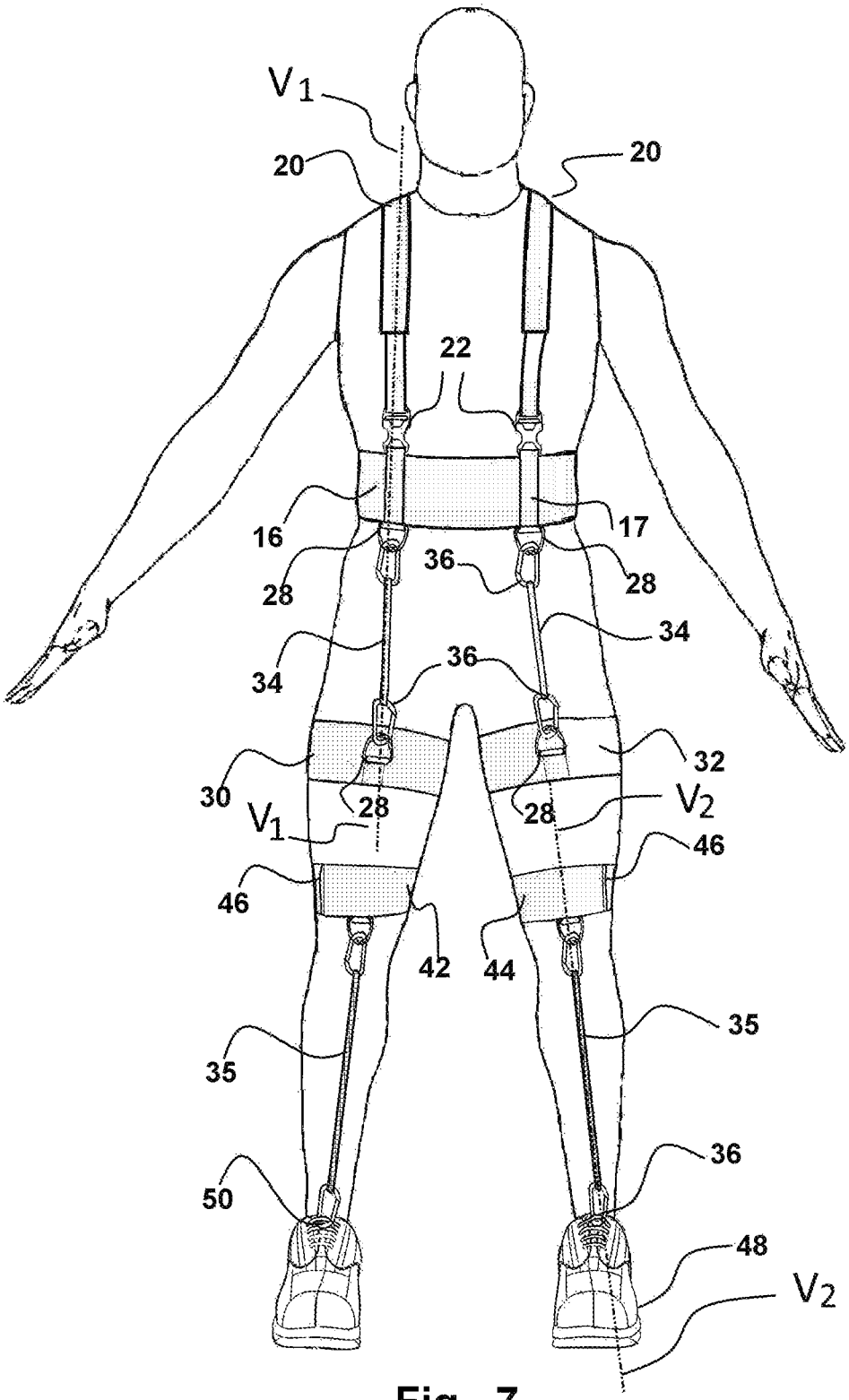

FIG. 7 shows a mode of the device herein in an as-used position, which may be employed with any of the shoulder strap configurations noted herein of FIGS. 1-5, and having two more resistance leg bands extending between connections at a first end with lower leg belts configured to encircle the leg above the knee, and at second ends with the shoelaces of a wearer.

DETAILED DESCRIPTION OF THE PREFERRED EMBODIMENTS OF THE INVENTION

In this description, any directional prepositions if employed, such as up, upwardly, down, downwardly, front, back, first, second, top, upper, bottom, lower, left, right and other such terms refer to the device or depictions as such may be oriented are describing such as it appears in the drawings and are used for convenience only. Such terms of direction and location are not intended to be limiting or to imply that the device herein has to be used or positioned in any particular orientation.

Figure 1:
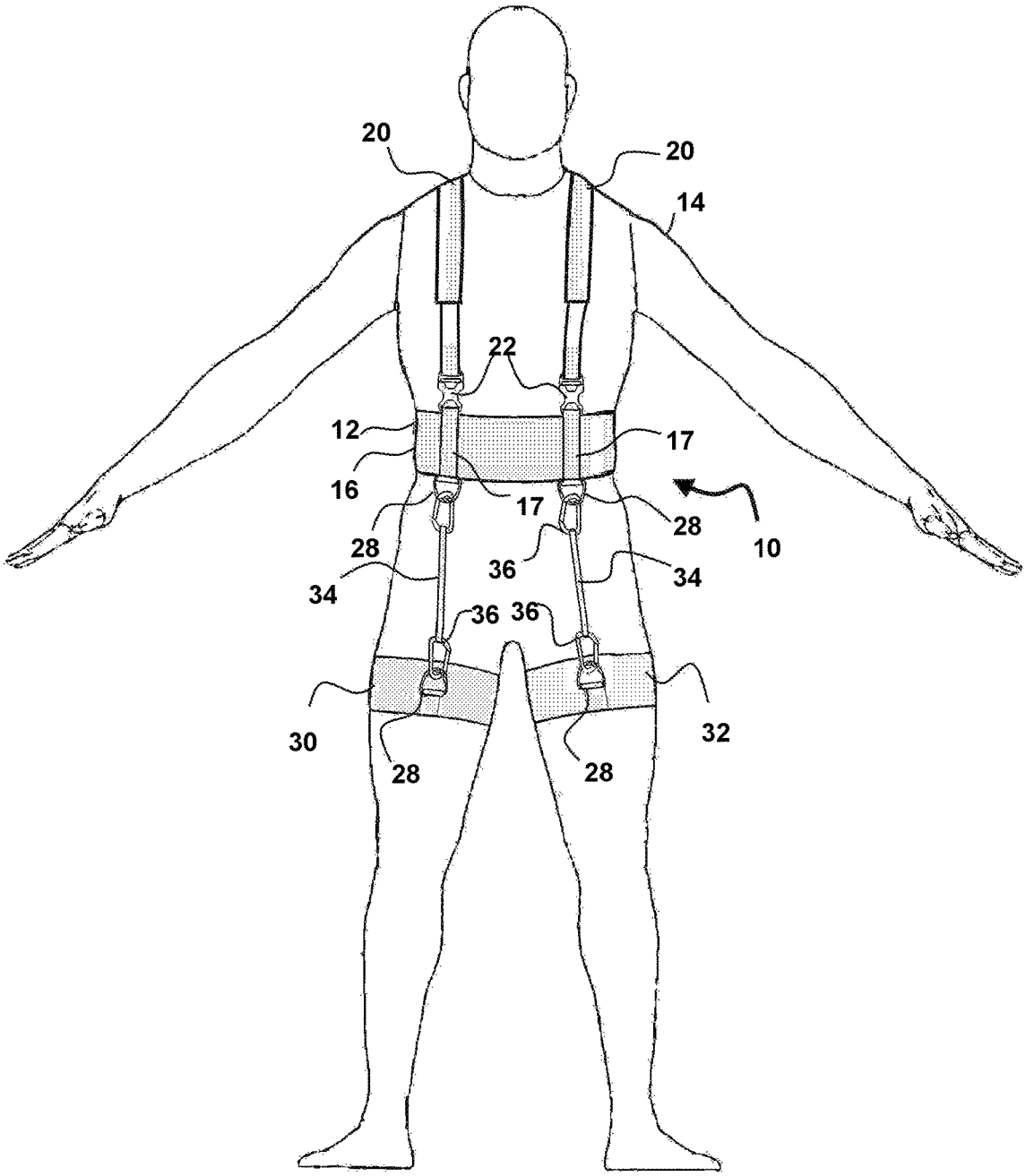
FIG. 1 depicts a mode of the device showing waist belt or belt in an encircled engagement of the mid section of the body of the user in an as-used position, with elastic members extending between engagements with each leg belt and the belt around the waist of the user, which is supported with two engaged shoulder straps.

Now referring to drawings in FIGS. 1-7, wherein similar components are identified by like reference numerals, there is seen in FIG. 1 one preferred mode of the device 10 showing the belt assembly 12 which includes a belt 16 adapted for an encircled engagement of the waist or mid section of the body 14 of the user. Such may be an encircled engagement of the belt 16 which is an elastic circular band, or a belt 16 which has ends which are positionable to a removable engagement.

The belt assembly 12 is shown with a waist belt, or belt 16, and may include a pair of reinforcing flexible belt members 17 extending across the width of the belt 16 from one edge to the opposite edge of the belt 16. Each one of this pair of belt members 17 are positioned on the belt 16 to be inline, or have an axis align with, connections of the first ends of each of the shoulder straps 20 to the belt 16 and confections of first ends of each of the bands 34 to the belt. Such shoulder strap 20 confections might be two mating connectors of the first ends of each shoulder strap 20 to an upper edge of the belt 16, and mating connectors on the lower end of the belt 16. Such connections of the first ends of the bands 34 may be mating connectors as shown herein may be connectors 36 on the bands 34, to rings 28 such as D-rings, extending from an inline connection to the opposite edge of the belt 16. Each of the pair of belt members 17 are preferred and formed of strong but flexible material such as nylon or polyester webbing similar to that of automotive seat belts for example, and are sewn, riveted, or otherwise firmly and permanent attached to the belt 16.

The belt assembly 12 as depicted may be formed of textile fabric such as canvas or rip stop, or a form fitting material such as textile-backed neoprene such as used for wetsuits, or combinations thereof. The belt 16 ends preferably are positionable to a removable engagement, where they may be engaged using releasable cooperative fasteners positioned at one end of the belt 16 adapted to removably engage mating cooperative fasteners at or adjacent the second end of the belt 16. Currently and as depicted in FIG. 2 for example, hook and loop fabric 18 may be employed, or any mating cooperative fastener adapted to hold one end of the belt 16 to the opposite end thereby encircling the body 14 of the user in a removable engagement. Such cooperative fasteners might also include snaps, buttons, hooks, buckles, and other fasteners adapted to the task.

Additionally shown in FIGS. 1-4 and 7, each of a pair of shoulder straps 20, are positionable to an engagement with a first edge of the belt 16 at a frontal position with the belt in the as-used positioning on the user 14. Opposite or second ends 23 of the shoulder straps 20 are in an operative engagement to maintain one shoulder strap 20 on one shoulder of the user and the second of the shoulder straps 20 on the opposite shoulder of the user. By operative engagement is meant, that the engagement of the second ends 23 may vary as noted herein so long one each of the shoulder straps 20 is maintained on a respective shoulder of the user with the device 10 in an as-used position.

This operative engagement may be an engagement of the shoulder straps 20 at second ends 23 extending around to the front of the user, or an engagement with the belt 16 on the back side of the user 14, or an engagement with a secondary belt 16*a* around the chest of the user 14.

Where a single strap encircles the neck to form two shoulder straps 20, the two second ends 23 of one shoulder strap 20 encircling the neck of the user may be removably engaged or formed as a unitary structure.

Alternatively, two shoulder straps 20 might be employed where first ends of the shoulder straps 20 are in engagements or removably engage with the a first edge of the belt 16 at the front of the user, and second ends 23 of both shoulder straps 20 removably engage at the first edge of the belt 16 on the back of the body 20 of the user in the same fashion as shown in FIG. 1, but on the rear of the waist belt 16, with the belt 16 in the as-used position, or they may be engaged with each other, or to a secondary strap.

The shoulder straps 20 are each in an engagement at one end to the belt 16. This engagement of the ends of the shoulder strap 20 or straps 20 in all modes of the device 10 to front or front and rear of the belt 16, could be permanent such as with rivets or sewing, but preferably for ease of use, is accomplished by the employment of mating fasteners as shown, which easily engage, and must be actuated to disconnect.

As shown in FIGS. 1 and 4 for example, these mating fasteners are provided by quick release buckles 22 which form a strong removable engagement of a buckle insert 24 into a buckle receiver 26 at a first edge of the belt 16 opposite a second edge. Such buckles 22 are easily removably engaged by insertion of the buckle insert 24 into the buckle receiver 26, but will not separate absent the user compressing the distal ends of members of the buckle insert 24 to disengage the buckle receiver 26. Of course other mating fasteners may be employed as would occur to those skilled in the art, such as snaps, hooks, rings, of other mating fasteners which easily engage and must be actuated to release.

Also depicted in FIG. 1 and other figures herein, are a first leg belt 30 configured to encircle one leg of the body 14 of the user about the thigh, and a second leg belt 32 adapted to encircle the second leg of the body 14 of the user. The leg belts 30 and 32 are preferably constructed of elastic material which may be stretched during engagement around their respective positions on the thigh or upper legs of the user, and which will engage the legs in an inwardly biased compressive engagement. This compressive engagement helps maintain each of the leg belts 30 and 32 in a fixed position on each respective leg of the user around the thigh. Currently a textile backed or laminated neoprene fabric similar to that employed in wetsuits, is a preferred material due to its elastic qualities yet comfortable engagement when encircling the leg.

The leg belts 30 and 32, may have easily removably engageable mating fasteners positioned at or adjacent each of the two ends of the leg belts 30 and 32, such as hook and loop fabric 18 (FIG. 2) which may be a combination hook and loop fabric, or a section of hook type fabric fastener and a section of loop type fabric fastener. As noted, such mating fasteners can also include snaps, buttons, hooks, or other means of engaging both ends of a leg belt or lower leg belt removably, to each other as would occur to those skilled in the art.

Alternatively, but not as easily engaged to the legs, the leg belts 30 and 32, may be formed as a connected ring structure with no loose ends, which may be slid upon the upper leg over the foot, and up to a compressively engaged position on the legs of the user. In either mode, a leg belt 30 and 32 encircles each leg of the user, and is adapted to form a compressive engagement with the exterior surface of the upper leg to help hold it stationary during use.

Shown in FIG. 2, is a rear view of the device 10 herein during engagement with the body 14 of a user. The strap 20 configuration shown in FIG. 2, is employed with the mode of the device 10 shown in FIGS. 3-4. As can be seen in FIG. 2, each of two shoulder straps 20 are formed of a flexible material in a permanently curved shape, where one each of the shoulder straps 20 will extend first in a linear shape such as shown in FIGS. 1 and 4, and which will then curve in shape as it passes over the shoulder of the user as in FIGS. 2 and 3.

The fabric forming the permanently curved shoulder straps 20 as shown in the particularly preferred mode of the device 10 of FIGS. 2-5, may be a combination of flexible webbing or other material for the linear section engaging the belt 16 at the front of the user, and a flexible material, which once cut, which will hold a curved shape as in FIGS. 2-3 for a second section 21 of the two straps 20. Currently a neoprene textile material having neoprene laminated to a cloth backing, similar to that used for wetsuits works well for the second section 21 as it may be cut in a curved shape for the second section 21, and will hold that shape.

This permanently curved shape of the shoulder straps 20, without a connection to the belt 16 on the back of the user 14, is preferred for two reasons. First by not connecting the second ends of the shoulder traps 20 to the belt 16 on the back of the user 14, experimentation as shown the device 10 is easier to use when running or walking, and also encourages the user to use back and torso muscles for posture during running and walking and thus exercising them. Also, as it has been found forming the shoulder straps 20 permanently curved, makes the shoulder straps 20 more comfortable when worn, and especially easy to connect as shown in FIG. 4, across the chest of the user. The second ends of each of the shoulder straps 20 opposite the first ends having the connection to the belt 16 may be engaged to each other in this fashion using the shown hook and loop fastener material 18 operatively positioned at each of the ends.

Also shown in FIGS. 2-3 are an engagement for both ends of the belt 16, to secure it around the waist of the user. A first end of the belt 16 is engaged to a second end of the belt 16 as depicted in FIGS. 2-3. As shown, a belt fastener to engage both ends is provided by a passage at one end of the belt 16 such as a ring 28 or formed passage in the belt 16, allows for a first end of the belt 16 to be threaded therethrough, and engaged with a fastener such as hook and loop fabric 18 positioned in between the first end of the belt 16 and the opposite end. The user may thus pull the first end of the belt 16 through the ring 28, and using hook and loop fabric 18 thereon, engage it to another section of hook and loop fabric 18 on the belt 16.

This belt 16 engagement may be seen in FIG. 3, which also shows the overlap of the ends of the first leg belt 30 and second leg belt 32 which are held in the encircled engagement by the connected removable fasteners thereon such as the hook and loop fabric 18 shown in FIG. 2. Of course other connections to secure the first end of the belt 16 to the second and around the waist of the user may be employed.

As shown in FIG. 4 which is a frontal view of the device 10 of FIGS. 2 and 3, and also shown in FIG. 1, elastic bands 34 are connected between the second edge of the belt 16 and a connection with the leg belts 30 and 32. The elastic band 34 may be formed of rubber, or fabric-covered rubber or other elastic material which will elongate and concurrently impart resistance to such elongation. The force of the resistance may be varied by making the elastic bands 34 thicker, or of rubber and rubber like materials having varying resistance to elongation. Such may be provided in a kit such as in FIG. 6.

At each end of each elastic band 34 is positioned a releasable connection to the belt 16 and a releasable connection to a leg belts 30 or 32. Such may use a releasable connector 36, which is adapted to engage the ring 28 positioned on the belt 16 and on an opposite end, with a ring 28 positioned upon a leg belts 30 or 32. Other releasable connections between the belt 16 and the bands 34 may be employed however the ring 28 and connector 36 work well and are simple to use.

The releasable connector 36 might be a hook with an open end, however, a ring 28 which has a biasly-closed opening such as a spring loaded opening found on a carabineer, has been found to yield a very secure engagement. While secure during use, such a carabineer type connector 36 is also easily disengaged by opening the spring loaded door of the carabineer to slip if from the ring 28 to which it engages.

As noted above, FIG. 4 shows a particularly preferred mode of the device 10, in an as-used positioning of the belt 16, with the shoulder straps 20 connected to the belt 16 which is encircling the waist or mid section of the user. The shoulder straps 20 are formed in the noted permanently curved configuration, with each respective permanently curved portion (FIGS. 2-3) following a curved pathway around the neck and back of the user 14 and under an arm opposite the side of the belt 16 to which they engage to each other at respective second ends 23. This places the removable engagement of the second ends 23 of the straps 20, in view of the sight of the user during positioning of the device 10 to the as-used positioning allowing for easy engagement and disengagement of the second ends 23 while viewing them.

Also shown, are the two elastic members or elastic bands 34 extending between connections at a first and second leg belt 30 or 32, and the waist-engaged belt 16. So configured and in the as-used position, the device 10 communicates resistive force from the elongating elastic bands 34 to the legs of the user as noted above, thereby increasing the strength of the leg muscles from exercise during walking and running.

In a particularly preferred mode of the device 10, the axis of both shoulder straps 20, shown running along imaginary line V1 of one shoulder strap 20 in FIG. 7, are substantially aligned with the axis of the elastic bands 34 also shown running along imaginary line V1, extending between the belt 16 and the leg belts 30 and 32 substantially align along a vector V1 (FIG. 7). By substantially aligned is meant that the axis shown as V1 in of both the straps 20 and the bands 34 are aligned at the junction thereof provided by the connectors 36, that both are aligned in a straight line, or at a dogleg at the junction point of the connectors 36 that the bands 34, where the axis of the straps 20 extends along a line that is within 4-12 degrees of the axis of the bands 34, with a favored configuration of alignment or within 5 degrees of being aligned. Further, if employed, the vector V2 (FIG. 7) formed along the axis of each of the elongated elastic leg bands 35 intersect at one end, with the rings 28 engaged to the leg belts 30 and 32 and would align with the axis of the bands 34 shown as running along V1, or would be within the same degree range noted above.

Thus, in substantial alignment of the axis of the straps 20 with the axis of the bands 34, shown as running along V1 can align with that of the straps 20 and elastic bands 34 when stretched, or form a dogleg therebetween at the junction formed by the connectors 36 and rings 28 on the waist belt 16 which deviates between 4-12 degrees or preferably at 5 degrees or less from being a straight line shown as V1. Further, in such a substantial alignment where the leg bands 35 are included the vector V2 determined by the axis of the leg bands 35 stretching between the shoes 48 and the lower leg belts 42 and 44, intersects the distal end connection of the ring 28 on the leg belts 30 and 32.

The substantially aligned shoulder straps 20, belt members 17, and elastic bands 34, which is preferred, serve to maintain the resistive force constant from the elongated elastic bands 34 or elongated elastic leg bands 35 if used, and also aligned during use. This alignment has been found to significantly enhance the results from the device 10 and ease of its use by the user by maintaining a constant aligned resistive biasing forces in position on their body 14. Further, when included with lower leg belts 42 and 44 (FIG. 7) and leg bands 35, it is preferred the belt 16, leg belts 30 and 32, and leg bands 35 are all configured by positioning the releasable connections to the bands 34 or leg bands 35 as the case may be, such that the leg bands 35, bands 34 and shoulder straps 20, are all substantially aligned, with the device engaged to the user. Such is depicted in FIG. 7 for example.

As also noted, FIG. 4*a*, depicts complimentary mating connectors shown as buckles 22 with first buckle insert 24 engageable with the buckle receiver 26.

FIG. 5 depicts another mode of the device 10 showing a shoulder harness configured as a single piece which would be slid over the head of the user. It includes the curved straps 20 which are engaged at one end to an encircling belt which can be removably connected across the chest of the user.

In FIG. 6 is depicted elastic members shown as elastic bands 34 which are engaged at both ends with connectors 36 shown as carabineers. As shown, the plurality of provided elastic bands 34 form a kit 38 of such elastic members where each may have a different force of resistance to elongation, thereby allowing the user to choose elastic bands 34 from the kit which are appropriate for the amount of force they wish to overcome during an exercise period. The leg bands 35 may also be provided as a kit 38 in the same manner as depicted in FIG. 6 to vary resistance.

In FIG. 7 is shown a mode of the device 10 herein having two more resistance leg bands 35 extending between a releasable connection such as with connectors 36 and rings 28, formed at a first end of each of a respective one of the elastic leg bands 35. The leg bands 35 also have a second respective releasable connection, with a first lower leg belt 42 and with a second lower leg belt 44. As with the other bands 34 other releasable connections may be employed such as hooks, snaps, tying, or other means to releasably engage the leg bands 35 at both ends.

Both the first lower leg band 42 and the second lower leg band 44, are formed of fabric which either slides over the leg to a biased compressed engagement with the leg just above the knee, or of fabric which encircles the lower leg just above the knee and engages with mating fasteners 46 such as hook and loop fabric, snaps, hooks, or other matting fasteners which will hold a first end of the leg belts 42 and 44 to a second end.

The leg bands 35, as with other bands 34 herein, are elastic and produce a resisting biasing force to stretching. They may be chosen by a resistance level to increase or decrease the workout, but in all modes the leg bands 35, once connected between connectors 36 engaged with the leg belts 42 and 44, and the shoes 48 of the user, are short enough to establish a biased and tight engagement with no slack.

Preferably, the second ends of both leg bands 35 are adapted in a releasable connection at second ends, which removably engages with the shoelaces 50 of the shoes 48 of the user. This makes for an easy engagement and it has been found that the resistance from the elongated elastic leg bands 35 imparting a pulling force upon the top of the foot engaged in the shoe 48, works best, for exercising the lower legs and feet during walking and running. While another strap (not shown) may be engaged around the middle of the shoe 48 and provide a ring 28 to removably engage the connector 36 on the leg bands 35, such a band would have to wrap around the shoe 48 and under the sole on which the user walks, and has been found in experimentation in some users, to impede their walking and be a source of tripping.

Consequently, adapting the leg bands 35 on second ends with a releasable connection adapted to engage with the shoelaces on the tops of the shoe 48 is particularly preferred for both convenience, and to eliminate any extra thickness on the bottom of the sole of the shoe 48 which would impede normal walking or running for users. Such an adapted engagement can be accomplished with connectors 36, or hooks, or small straps with buckles or hook and loop fabric, or the like which will engage around one or more of the shoelaces 50, and hold the second end of the leg bands 35 adjacent the shoe 48, where the biasing force of the elastic in the leg bands 35 will pull upward from the laces 50.

While all of the fundamental characteristics and features of the exercise device system herein have been shown and described herein, with reference to particular embodiments thereof, a latitude of modification, various changes and substitutions are intended in the foregoing disclosure and it will be apparent that in some instances, some features of the invention may be employed without a corresponding use of other features without departing from the scope of the invention as set forth. It should also be understood that upon reading this disclosure and becoming aware of the disclosed novel and useful device and system herein disclosed, that various substitutions, modifications, and variations may occur to and be made by those skilled in the art, without departing from the spirit or scope of the invention. Consequently, all such modifications and variations and substitutions, as would occur to those skilled in the art are considered included within the scope of the invention as defined by the following claims.

What is claimed is:

1. A running exercise apparatus, comprising:

a belt configured for an engagement around the waist of a user in an as-used position;

a first shoulder strap having a first end in a connection to said belt at a frontal portion of said belt on a front of the body of said user with said belt in said as-used positioning;

a second shoulder strap having a first end in a connection to said belt on said frontal portion of said belt;

a second end of said first shoulder strap and a second end of said second shoulder strap in an operative engagement to maintain said first shoulder strap extending over a first shoulder of said user and said second shoulder strap extending over a second shoulder of said user;

a first leg belt engageable around an upper leg portion of a first leg of said user;

a second leg belt engageable around an upper leg portion of a second leg of said user;

a first elastic band extending between a first end in a first connection to said belt, to a second end in a second connection said first leg belt;

a second elastic band extending between a first end in a first connection to said belt, to a second end in a second connection said first leg belt;

a pair of belt members extending across said belt;

a first of said pair of belt members extending between said connection of said first end of said first shoulder strap to said belt and said first connection of said first elastic band to said belt; and a second of said pair of belt members extending between said connection of said first end of said second shoulder strap to said belt and said first connection of said second elastic band to said belt.

2. The running exercise apparatus of claim 1, additionally comprising:

an axis of said first shoulder strap running from a first shoulder of said user to said connection to said frontal portion of said band, being in substantial alignment with an axis of said first elastic band; and an axis of said second shoulder strap running from a second shoulder of said user to said connection to said frontal portion of said band, being in substantial alignment with an axis of said second elastic band.

3. The running exercise apparatus of claim 1, additionally comprising:

a first lower leg band configured for engagement to a lower leg of a first leg of said user adjacent a first knee;

a second lower leg band configured for engagement to a lower leg of a second leg of said user adjacent a second knee;

a first elastic leg band in a connection at first end to said first lower leg band, said first elastic leg band adapted for an engagement to a first shoe of said user at a second end; and a second elastic leg band in a connection at first end to said second lower leg band, said second elastic leg band adapted for an engagement to a second shoe of said user at a second end.

4. The running exercise apparatus of claim 2, additionally comprising:

a first lower leg band configured for engagement to a lower leg of a first leg of said user adjacent a first knee;

a second lower leg band configured for engagement to a lower leg of a second leg of said user adjacent a second knee;

a first elastic leg band in a connection at first end to said first lower leg band, said first elastic leg band adapted for an engagement to a first shoe of said user at a second end; and a second elastic leg band in a connection at first end to said second lower leg band, said second elastic leg band adapted for an engagement to a second shoe of said user at a second end.

5. A running exercise apparatus, comprising:

a belt configured for an engagement around the waist of a user in an as-used position;

a first shoulder strap having a first end in a connection to said belt at a frontal portion of said belt on a front of the body of said user with said belt in said as-used positioning;

a second shoulder strap having a first end in a connection to said belt on said frontal portion of said belt;

a second end of said first shoulder strap and a second end of said second shoulder strap in an operative engagement to maintain said first shoulder strap extending over a first shoulder of said user and said second shoulder strap extending over a second shoulder of said user;

a first leg belt engageable around an upper leg portion of a first leg of said user;

a second leg belt engageable around an upper leg portion of a second leg of said user;

a first elastic band extending between a first end in a first connection to said belt, to a second end in a second connection said first leg belt;

a second elastic band extending between a first end in a first connection to said belt, to a second end in a second connection said first leg belt;

said first shoulder strap having a permanently curved portion formed in-between said first end and said second end thereof;

said second shoulder strap having a permanently curved portion formed in-between said first end and said second end thereof;

said operative engagement of said second end of said first shoulder strap and said second end of said second shoulder strap being a removable engagement formed between said second end of said first shoulder strap and said second end of said second shoulder strap; and said removable engagement being positioned adjacent to said frontal portion of said belt thereby said removable engagement viewable by said user for an engagement or disengagement thereof.

6. The running exercise apparatus of claim 2, additionally comprising:

said first shoulder strap having a permanently curved portion formed in-between said first end and said second end thereof;

said second shoulder strap having a permanently curved portion formed in-between said first end and said second end thereof;

said operative engagement of said second end of said first shoulder strap and said second end of said second shoulder strap being a removable engagement formed between said second end of said first shoulder strap and said second end of said second shoulder strap; and said removable engagement being positioned adjacent to said frontal portion of said belt thereby said removable engagement viewable by said user for an engagement or disengagement thereof.

7. The running exercise apparatus of claim 3, additionally comprising:

said first shoulder strap having a permanently curved portion formed in-between said first end and said second end thereof;

said second shoulder strap having a permanently curved portion formed in-between said first end and said second end thereof;

said operative engagement of said second end of said first shoulder strap and said second end of said second shoulder strap being a removable engagement formed between said second end of said first shoulder strap and said second end of said second shoulder strap; and said removable engagement being positioned adjacent to said frontal portion of said belt thereby said removable engagement viewable by said user for an engagement or disengagement thereof.

8. The running exercise apparatus of claim 4, additionally comprising:

said first shoulder strap having a permanently curved portion formed in-between said first end and said second end thereof;

said second shoulder strap having a permanently curved portion formed in-between said first end and said second end thereof;

said operative engagement of said second end of said first shoulder strap and said second end of said second shoulder strap being a removable engagement formed between said second end of said first shoulder strap and said second end of said second shoulder strap; and said removable engagement being positioned adjacent to said frontal portion of said belt thereby said removable engagement viewable by said user for an engagement or disengagement thereof.

* * * * *